US007375469B2

(12) United States Patent
Chou et al.

(10) Patent No.: US 7,375,469 B2
(45) Date of Patent: May 20, 2008

(54) ELECTRODE STRUCTURE OF PLANAR LAMP

(75) Inventors: Chin-Wen Chou, Hsin-Tien (TW); Ying-Nan Cheng, Hsin-Tien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 529 days.

(21) Appl. No.: 11/047,672

(22) Filed: Feb. 2, 2005

(65) Prior Publication Data

US 2006/0170359 A1 Aug. 3, 2006

(51) Int. Cl.
*H01J 17/04* (2006.01)
*H01J 61/04* (2006.01)

(52) U.S. Cl. ..... 313/631; 313/491; 313/607; 313/634

(58) Field of Classification Search ..... 313/484, 313/485, 491, 493, 607, 631, 634, 643
See application file for complete search history.

(56) References Cited

U.S. PATENT DOCUMENTS 5,220,249 A * 6/1993 Tsukada ..... 315/246
5,233,262 A * 8/1993 Lynn et al. ..... 313/113
5,466,990 A * 11/1995 Winsor ..... 315/56
6,114,809 A * 9/2000 Winsor ..... 315/50
6,639,351 B1 * 10/2003 Tsai et al. ..... 313/491
2002/0136018 A1 * 9/2002 Yoo ..... 362/484
2006/0255737 A1 * 11/2006 Tsukada ..... 315/246

FOREIGN PATENT DOCUMENTS

TW 521300 2/2003

* cited by examiner

*Primary Examiner*—Nimeshkumar D. Patel
*Assistant Examiner*—Kevin Quarterman
(74) *Attorney, Agent, or Firm*—Muncy, Geissler, Olds & Lowe, PLLC

(57) ABSTRACT

The present invention discloses an improved electrode structure of planar lamp, which applies to the planar lamp that has a gas-discharge cavity with at least a bending channel and with a discharge gas and a fluorescent material equipped thereinside. Via disposing an electrically conductive element, which traverses the bending channels, onto the discharge electrodes on the external wall of the gas-discharge cavity, the input area of the power output by the discharge electrodes is increased, and thus, the light uniformity of the planar lamp is achieved.

5 Claims, 6 Drawing Sheets

ELECTRODE STRUCTURE OF PLANAR LAMP

BACKGROUND OF THE INVENTION

1. Field of the Invention

The present invention relates to an improved electrode structure of planar lamp, particularly to one, wherein an electrically-conductive element that traverses the bending channels of the planar lamp is adopted to increase the input area of the power output by the discharge electrodes so as to achieve the light uniformity of the planar lamp.

2. Brief Discussion of the Related Art

What the planar fluorescent lamp lays most stress on is to achieve the uniform distribution of light, and the operational principle of the conventional planar gas-discharge lamp, which is used as the backlight source, is that with an inverter providing the power, the fluorescent material coated on the light-emitting side is excited to emit light via the means of gas (usually an inert gas) discharging. For the similar technology, please refer to R.O.C. Patent Publication No. 521300 "Dielectric Barrier-Type Discharge Lamp With Support Element Between Bottom Plate And Cover Plate". According to the electrode design, the gas-discharge lamp can be divided into the external-electrode type (referring to FIG. 1) and the internal-electrode type, wherein a closed cavity is formed between the top-layer glass of the light-emitting face and the bottom-layer glass of the light-reflecting face and the closed cavity is filled with a reaction gas, and wherein a support portion is usually formed in the cross section of the top-layer glass, and wherein a fluorescent material is coated on the internal surface neighboring the light-emitting face and a reflective material, which can reflect the light propagating downward, is coated on the internal surface neighboring the light-reflecting face; in the external-electrode type gas-discharge lamp, the electrodes adhere to the external surface of the bottom-layer glass and an insulating layer is coated over the electrodes; in the internal-electrode type one, the electrodes are disposed inside the closed cavity, and a support element is used to separate the top-layer glass and the bottom-layer glass. Once receiving the power transformed by the inverter, the reaction gas inside the cavity will discharge and emit the ultraviolet ray to excide the fluorescent material to emit light.

In the external-electrode type planar gas-discharge lamp, in order not to influence discharge, the reflective material must be very thin; therefore, a portion of light emitted from the fluorescent material is apt to transmit through the light-reflecting face, and the insulating layer has no reflective ability, which further induces the light to leak from the light-reflecting face more seriously; thus, the light efficiency is influenced. Furthermore, as shown in FIG. 1, in both the internal-electrode type and the external-electrode type, the electrodes are usually disposed in both ends of the planar lamp; as the electrodes of both ends of the planar lamp have many bending channels, a higher initial voltage for discharge is needed in the portions of the sharp corners of bending channels; however, the light in some portions is still dim as the distance between the electrodes is too long.

SUMMARY OF THE INVENTION

The primary objective of the present invention is to solve the aforementioned problem. The present invention adopts an electrically conductive element, which traverses the bending channels of the planar lamp, to increase the power-input area to enable every electrically conductive channel to create gas-discharge and excite the fluorescent material to emit light so that the light uniformity of the planar lamp can be achieved.

Another objective of the present invention is to realize the electrically-conductive element via applying an adhesive carbon-fiber patch with an electrically-conductive paste to the discharge electrodes in order to reduce the manufacture cost and promote the quality and the manufacture efficiency.

Still another objective of the present invention is to apply the present invention to a U-type tube lamp.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

In cooperation with the attached drawings, the detailed description and the technical contents of the present invention will be stated below.

Figure 1:
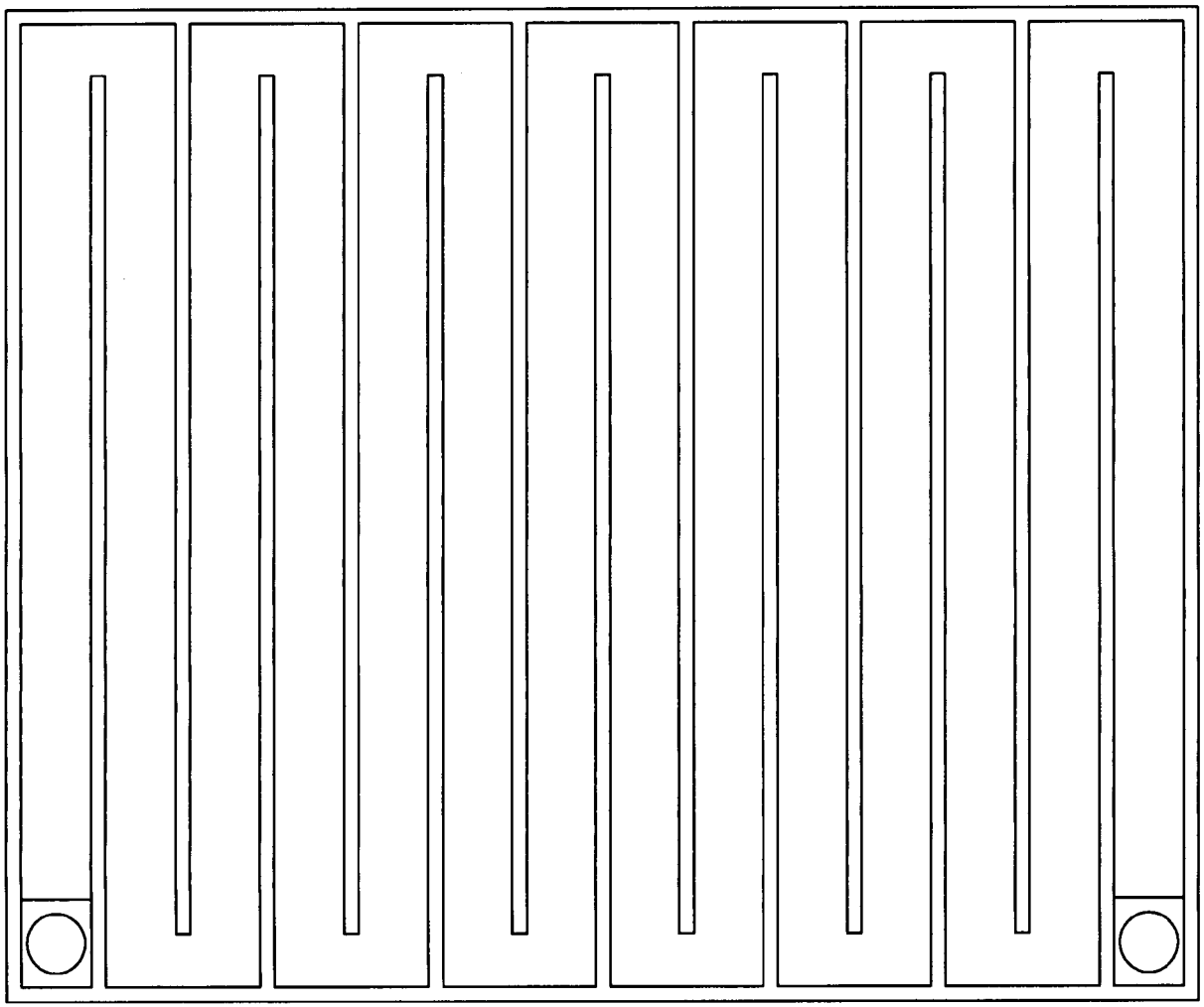
Fig. 1 PRIOR ART
FIG. 1 is a schematic diagram showing the disposition of the conventional discharge electrodes of the planar lamp.
Figure 2:
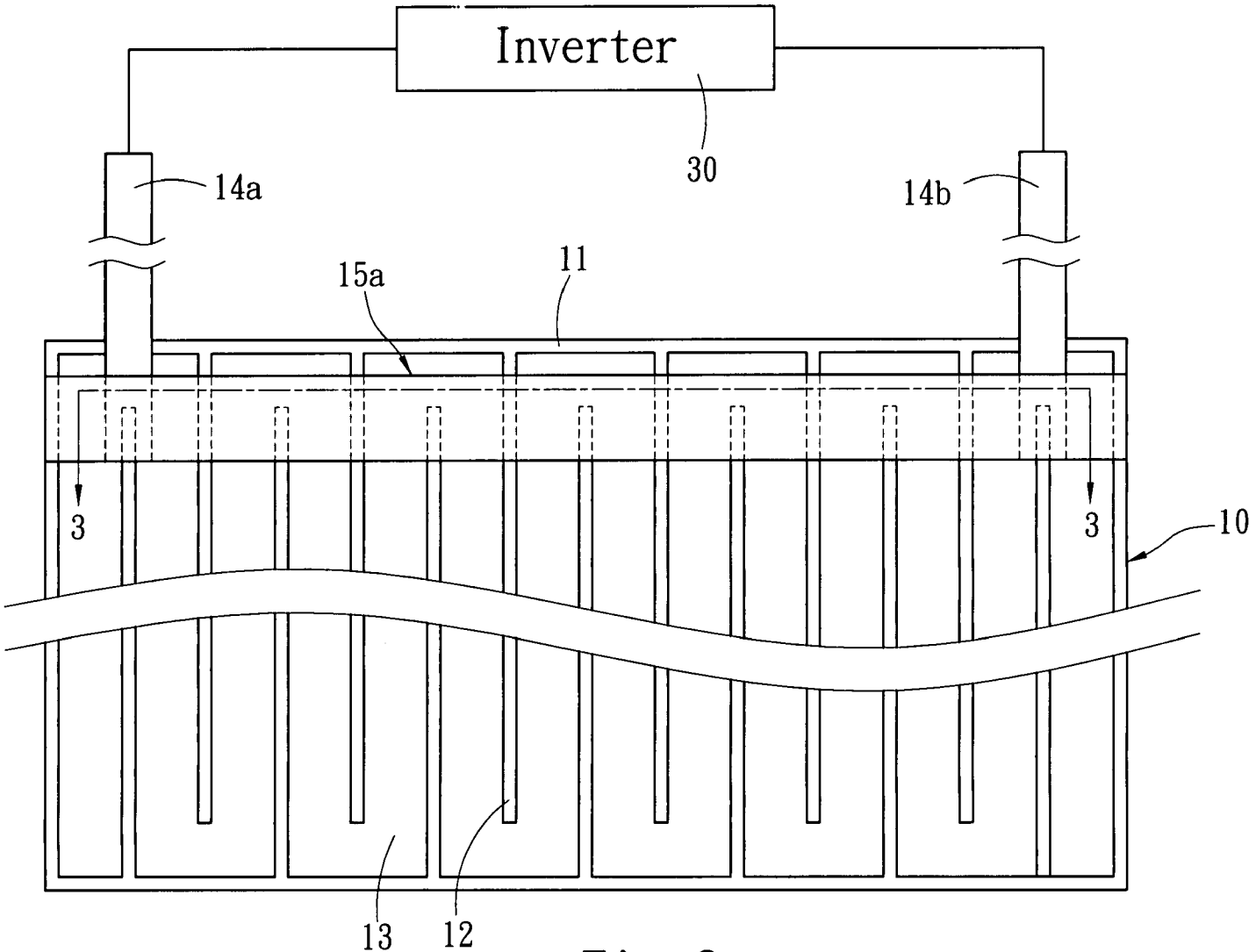
FIG. 2 is a schematic diagram showing the disposition of the present invention's discharge electrodes of the planar lamp.
Figure 3:
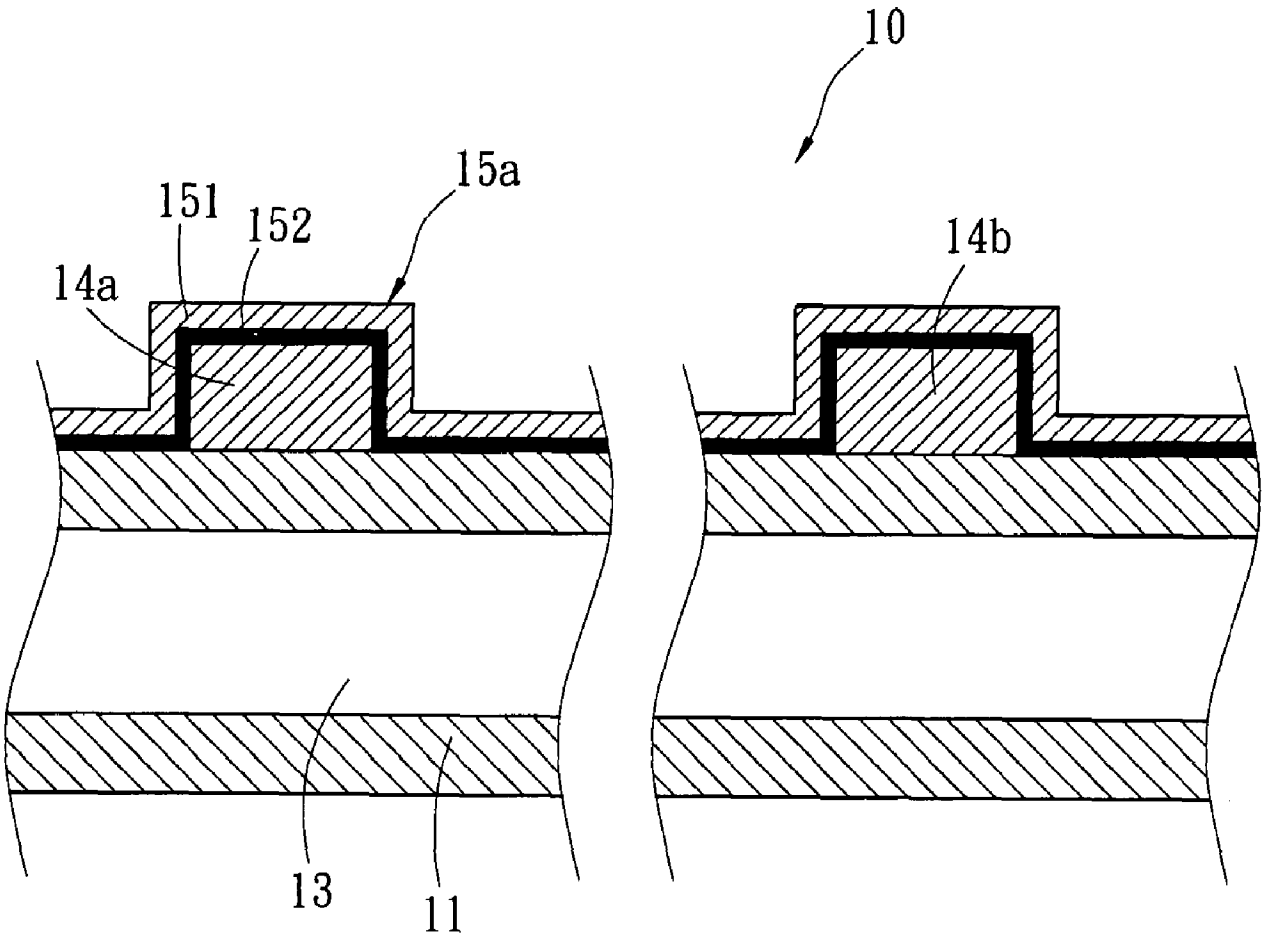
FIG. 3 is a schematic sectional view along line A-A.

Refer to FIG. 2 and FIG. 3 schematic diagrams showing the disposition of the discharge electrode 14*a* and 14*b* of the planar lamp 10. The present invention applies to a planar lamp 10, which has a gas-discharge cavity 11 with at least one bending channel 13. The bending channel 13 can be formed via partitioning the interior of the gas-discharge cavity 11 with separators 12. The interior of the gas-discharge cavity 11 is equipped with a fluorescent material and a discharge gas, and metallic discharge electrodes 14*a* and 14*b* are disposed on the external wall of the gas-discharge cavity 11. The discharge electrodes 14*a* and 14*b* are electrically connected to an inverter 30. In the present invention, the discharge electrodes 14*a* and 14*b* are installed on the surface of at least one external wall of the gas-discharge cavity 11, and an electrically conductive elements 15*a* and 15*b*, which traverses the bending channels 13, are further installed on the discharge electrodes 14*a* and 14*b*.

Figure 4:
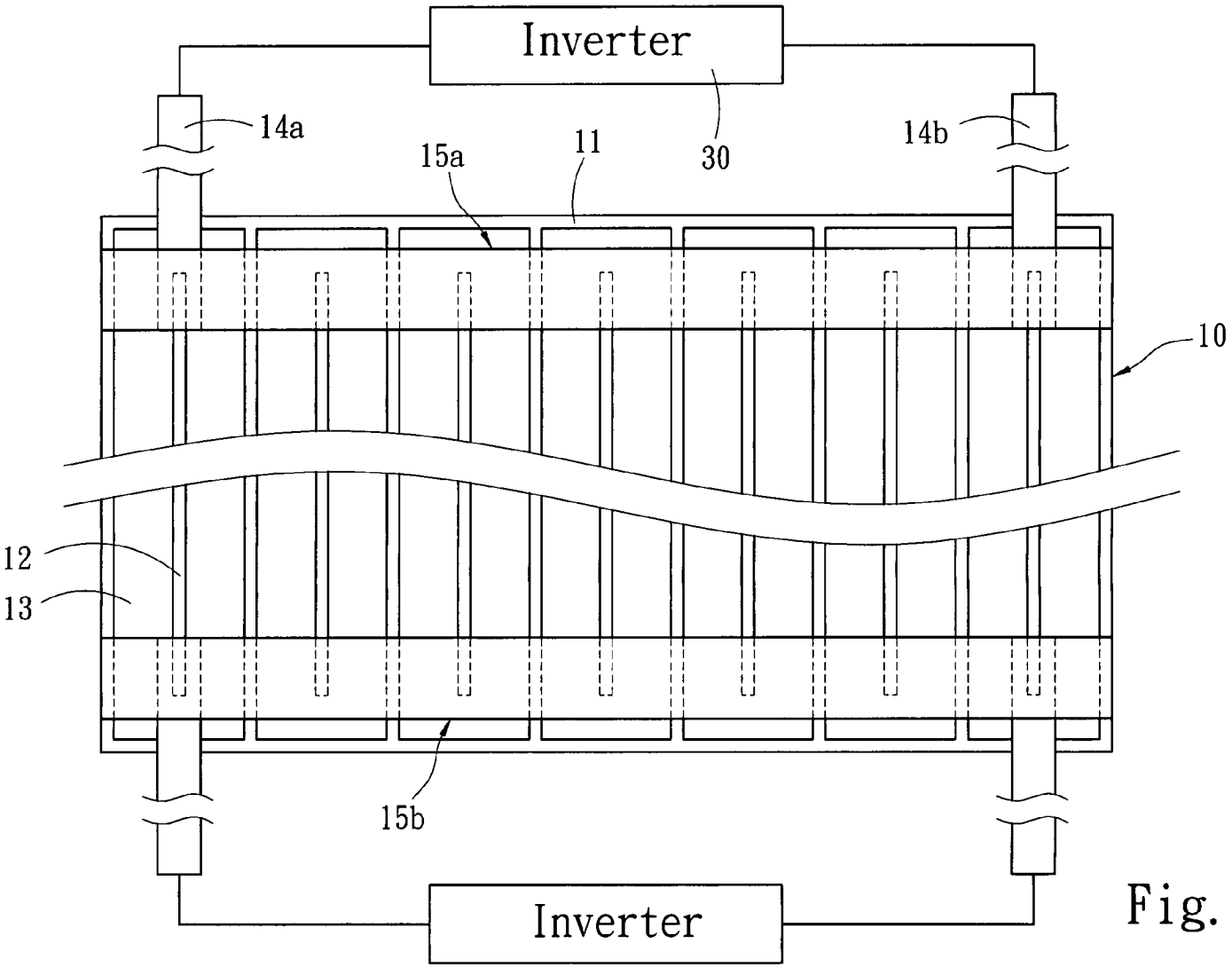
FIG. 4 is a schematic diagram of a second embodiment of the present invention.
Figure 5:
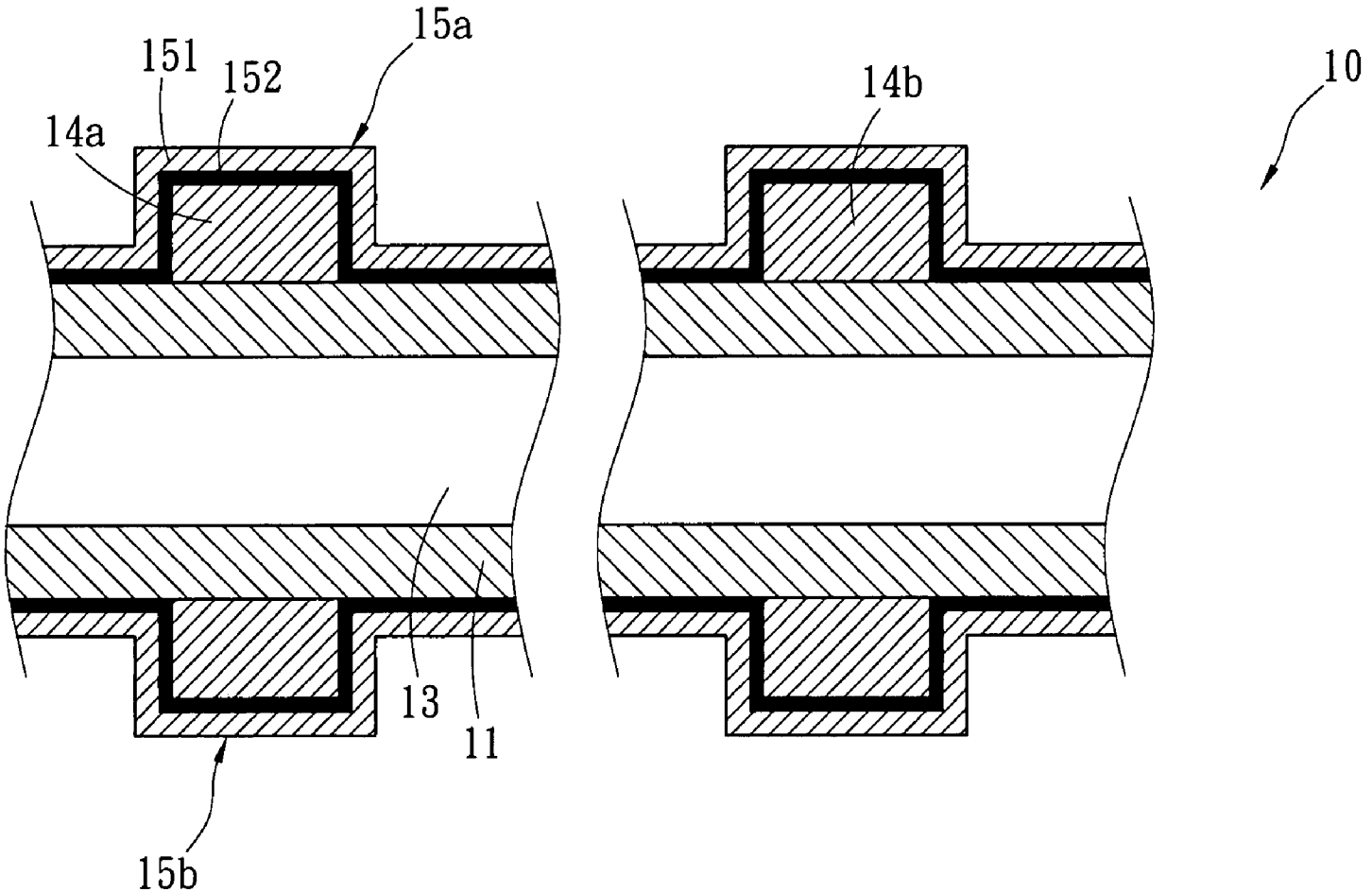
FIG. 5 is a schematic diagram of a third embodiment of the present invention.
Figure 6:
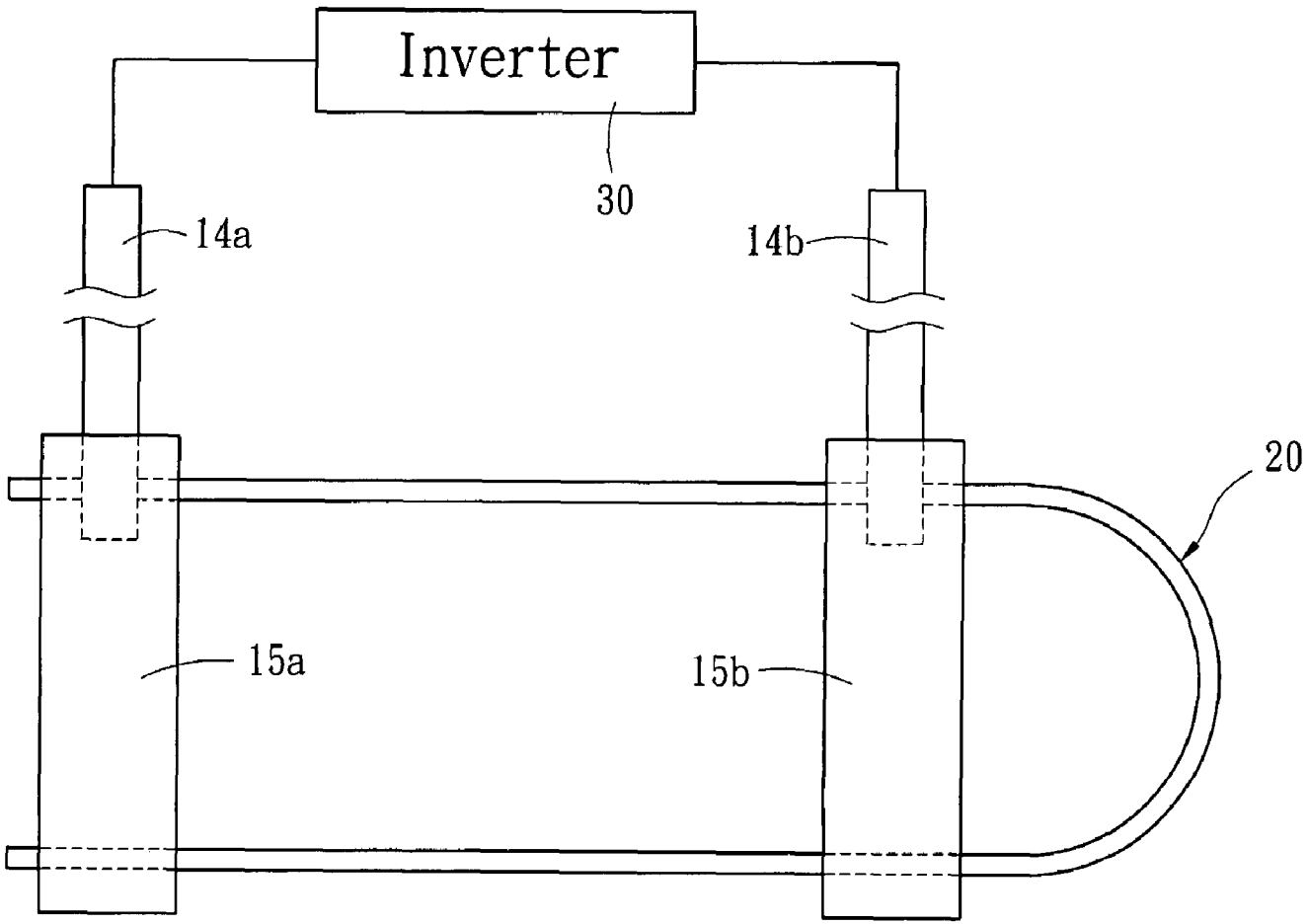
FIG. 6 is a schematic diagram showing that the present invention applies to a U-type tube lamp.

In FIG. 2 and FIG. 3, the discharge electrodes 14*a* and 14*b*, and the electrically conductive elements 15*a* and 15*b* of the present invention are disposed on the upper end of the top surface of the gas-discharge cavity 11. In FIG. 4, the discharge electrodes 14*a* and 14*b*, and the electrically conductive elements 15*a* and 15*b* of the present invention are disposed on both the upper end and the lower end of the top surface of the gas-discharge cavity 11. In FIG. 5, the discharge electrodes 14*a* and 14*b*, and the electrically conductive elements 15*a* and 15*b* of the present invention are disposed on both the upper end and the lower end of both the top surface and the bottom surface of the gas-discharge cavity 11. FIG. 6 shows that the present invention can also apply the U-type tube lamp 20. The number of the discharge electrodes 14*a* and 14*b*, and the electrically conductive elements 15*a* and 15*b* are dependent on the power provided by the inverter 30 and the size of the planar lamp 10. The electrically conductive elements 15*a* and 15*b* of the present invention is formed of an adhesive carbon-fiber patch 152 with an electrically conductive paste 151; thus, the electrically conductive elements 15*a* and 15*b* can be fabricated easily and applied to the discharge electrodes 14*a* and 14*b* conveniently. The way of inputting the power to the discharge electrodes 14*a* and 14*b* can adopt a unidirectional high-low potential mode or a bi-directional push-pull mode. It is obvious in all the embodiments that although the discharge electrodes 14*a* and 14*b* are separately disposed on either end of the planar lamp 10, owing to the present invention's electrically-conductive elements 15*a* and 15*b* traversing every bending channel 13, each bending channel can also has gas discharge to excite the fluorescent material to emit light. Thus, the problem that the distance of the conventional discharge electrodes 14*a* and 14*b* is too long and the light is dim in some portions of the conventional planar lamp 10 with the bending channels can be solved. Therefore, the present invention can achieve the objective of the light uniformity of the planar lamp.

Those described above are only the preferred embodiments of the present invention and not intended to limit the scope of the present invention, and any equivalent modification and variation according to the claims of the present invention is to be included within the scope of the present invention.

What is claimed is:

1. An electrode structure of a planar lamp, said planar lamp having a gas-discharge cavity with at least one bending channel, the interior of said gas-discharge cavity being equipped with a fluorescent material and a discharge gas, and discharge electrodes being disposed on the external wall of said gas-discharge cavity, wherein said discharge electrodes are installed on the surface of at least one external wall of said gas-discharge cavity, and wherein an electrically conductive element, which traverses said bending channels, is installed on said discharge electrodes, said electrically conductive element being an adhesive carbon-fiber patch with an electrically conductive paste.

2. The electrode structure of a planar lamp according to claim 1, wherein said planar lamp is a U-shaped tube lamp.

3. The electrode structure of a planar lamp according to claim 1, wherein said discharge electrode is a metallic electrode.

4. The electrode structure of a planar lamp according to claim 1, wherein said discharge gas is an inert gas.

5. The electrode structure of a planar lamp according to claim 1, wherein the interior of said gas-discharge cavity is partitioned by separators to form a plurality of bending channels.

* * * * *